US007690618B2

(12) United States Patent
Halstead

(10) Patent No.: US 7,690,618 B2
(45) Date of Patent: Apr. 6, 2010

(54) POSITION ADJUSTMENT MECHANISM

(76) Inventor: Roger Geoffrey Halstead, 10 Cromlix Close, Chislehurst, Kent (GB) BR7 5SJ ( * ) Notice: Subject to any disclaimer, the term of this patent is extended or adjusted under 35 U.S.C. 154(b) by 1352 days.

(21) Appl. No.: 10/800,565

(22) Filed: Mar. 15, 2004

(65) Prior Publication Data

US 2004/0240333 A1 Dec. 2, 2004

Related U.S. Application Data

(63) Continuation-in-part of application No. PCT/GB02/04175, filed on Sep. 13, 2002.

(51) Int. Cl.
*F16M 13/00* (2006.01)

(52) U.S. Cl. ..... 248/602; 248/599; 248/622; 248/631; 188/286; 188/287; 188/297; 188/265

(58) Field of Classification Search ..... 248/599, 248/602, 622, 631; 188/286, 287, 297, 265
See application file for complete search history.

(56) References Cited

U.S. PATENT DOCUMENTS 4,819,770 A * 4/1989 Hahn ..... 188/284

FOREIGN PATENT DOCUMENTS

CH 304668 A 1/1955
EP 0165190 A 12/1985

* cited by examiner

*Primary Examiner*—J. Allen Shriver, II
*Assistant Examiner*—Nkeisha J Smith
(74) *Attorney, Agent, or Firm*—Lawrence E. Laubscher, Jr.

(57) ABSTRACT

The present invention relates to a position adjustment mechanism, comprising two cylindrical portions, a first one of the portions being slidably disposed inside a second one of the portions. One of the portions has at least three detents and the other portion has at least three members for engaging in respective the detents to hold the portions in a first position, the members being removable from the detents to allow the portions to move into a second position; wherein the detents and members are equi-spaced around the first and second portions.

11 Claims, 7 Drawing Sheets

POSITION ADJUSTMENT MECHANISM

This application is a continuation-in-part of PCT/GB02/04175 filed 13 Sep. 2002.

BACKGROUND OF THE INVENTION

The present invention relates to a position adjustment mechanism, and more particularly to an adjustment mechanism for use in raising and lowering the height of the bed of a snooker table, billiards table, pool table or the like.

Snooker tables, and tables for playing related games such as billiards and pool, are of course well known. Such tables can be used as dining tables, by resting a cover on the cushions of the table, but the dining table formed by doing this is generally not at a convenient height for dining, as the surface of the dining table is normally too high. The height difference is normally around 75 mm (3 inches).

BRIEF DESCRIPTION OF THE PRIOR ART

Mechanisms are known for adjusting the height of the surface of the table, thus allowing the table to used both as a snooker table (or a billiards or pool table) and as a dining table. When it is desired to convert the table to a dining table, the height of the bed of the table is lowered, and a cover is laid across the cushions.

A prior art height adjusting mechanism 110, which has been known for many years, is shown in FIG. 1.

This prior art mechanism includes a first part 112, which is connected to the frame of the table, and a second part 130 which is connected to the bed. The parts are shown separated for clarity. As can be seen, the first part 112 comprises a generally flat member 114, which is normally formed from a metal such as brass. A number of grooves 116 are formed on a face of the flat member. The member is also formed with holes 118 for screws or the like, allowing it to be attached to a support frame of the table.

The second part 130 is formed to engage with the first member so that it can slide relative to the first member in the direction A-A. The second part also comprises a peg 132 for engaging in the grooves 116 on the first part 112. The peg 132 can slide in a slot 134 formed in the second part, the slot extending transverse to the direction A-A. The second part 130 also has a part 136 allowing it to be connected to the underside of a bed of a snooker table.

The operation of the prior art height adjusting mechanism 110 will now be briefly discussed. When the bed is in its lifted (playing) position, the peg 132 of the second part 130 engages in a detent 120, and is retained therein by the weight of the bed urging it downwardly.

When it is desired to move the bed to its lowered (dining) position, it is necessary to lift the bed, so that the peg 132 is lifted from the detent 120. The peg 132 comes into contact with a rib 122, which urges it sideways in the slot 134. The bed is then lowered, and the peg moves downwardly in groove 124 to the side of the detent 120. This movement of the peg 132 past the detent 120 allows the bed of the table to be lowered.

When it is desired to move the bed back to its lifted (playing) position, the bed is again lifted. The peg 132 now moves along groove 126, and at the top of the groove is urged sideways in the slot by rib 128. The bed is then lowered, so that the peg 132 enters detent 120.

One problem with the prior art height adjusting mechanism 110 is that the peg 132 is moved in the slot 134 purely by contact with the grooves and ribs of the first part. It is possible for the peg to "jam" during the lifting or lowering process; for example, it can come into direct contact with the lowermost part of rib 122, and now be moved sideways as a result of this contact. If this occurs, it is necessary to move the bed laterally with respect to the frame, to attempt to dislodge the peg, which can be difficult as the beds of snooker tables normally have a considerable mass.

Further, the prior art height adjusting mechanism must be mounted directly between the support frame of the table, to which the legs of the table are attached and the bed. This can cause problems if the bed is particularly thick, as is the case if the table is used for playing pool and includes a ball-return mechanism.

SUMMARY OF THE INVENTION

According to the invention, there is provided a position adjustment mechanism, the mechanism comprising: —two cylindrical portions, a first one of the portions being slidably disposed inside a second one of the portions, wherein one of the portions has at least three detents and the other portion has at least three members for engaging in respective the detents to hold the portions in a first position, the members being removable from the detents to allow the portions to move into a second position; wherein the detents and members are equi-spaced around the first and second portions. Having three such equi-spaced detents and members affords enhanced stability and solidity. In this regard, being equi-spaced, the detents and members are provided at substantially 120° intervals around the circumference of the portions and hence are not diametrically opposite one another. This avoids the possibility that the members will effectively form an axle about which the portions would tend to rock in relation to one another.

Moreover, where only a single detent and member is provided, there is a greater possibility that the cylindrical portions will be misaligned, such that excess forces are exerted on the member causing it to shear. Providing two detents and members also can be problematic as indicated above, since if one of the cylindrical portions has rocked to one side it will be misaligned and forces on the two members will not be equally shared. This can lead to the one bearing the excess forces failing, following which the remaining one will fail.

Preferably, the portions are biassed away from each other by a resilient device. The use of cylindrical portions allows the provision of such a resilient device-positioned between the portions. These resilient device tend to urge the positions apart, and this helps prevent the mechanism from jamming.

Preferably, the detents are upwardly open. The members can then be retained in the detents by gravity.

In a preferred form, the detents are formed on the first portion, and the members are formed on the second portion. It is preferred for each detent to form part of a groove formed on the first portion, with the members engaging in respective grooves.

In a preferred form, the grooves each form a circuit, and the members move around their respective circuit as the portions move from their first position to their second position and back to their first position.

It is further preferred for there to be an odd number of grooves, and a corresponding number of members, greater than one. This reduces the chance of the mechanism jamming.

Preferably, one of the portions is in contact with a first body and the other of the portions is in contact with a second body, with motion of the portions between the first position and the second position serving to adjust the vertical distance between the bodies.

Conveniently, the detents are aligned in the longitudinal axis of the cylindrical portions. In other words, a lower detent is vertically below an upper detent. This means that the process of moving the member from one detent to another does not leave the cylindrical portions relatively twisted.

In a preferred embodiment, a chamber is formed between the cylindrical portions, relative movement of the cylindrical portions being effected through pressurizing or depressurizing the chamber.

According to a further aspect of the present invention there is provided apparatus for holding two elements at two longitudinally spaced positions, the apparatus comprising: —a cam circuit provided for a first one of the elements; a cam follower provided for a second one of the elements; wherein the cam circuit directs the cam follower around the circuit as a result of alternating relative longitudinal movements of the first and second elements, relative longitudinal movements between the elements in one direction being effected through pressurizing or depressurizing a chamber formed between the elements.

With such an arrangement, the need to manually lift an object being supported by the apparatus is avoided. Preferably, the first and second elements comprise respective first and second cylindrical portions, the first one of which is disposed inside the second. In this manner, the first and second cylindrical portions can function as a piston/cylinder arrangement.

Preferably, an end of the first cylindrical portion together with an internal bore of the second cylindrical portion form the chamber between the elements.

The chamber conveniently has a combined fluid inlet/outlet. Multiple inlet/outlets may provided where suitable.

The apparatus preferably has a plurality of cam circuit/cam follower combinations positioned non-diametrically opposite around the circumference of the cylindrical portions. Conveniently, three such cam circuit/cam follower combinations are provided at equal intervals around the circumference of the cylindrical portions.

BRIEF DESCRIPTION OF THE FIGURES

A preferred embodiment of the invention will now be described by way of example only and with reference to the accompanying drawings, in which.

DETAILED DESCRIPTION

Figure 1:
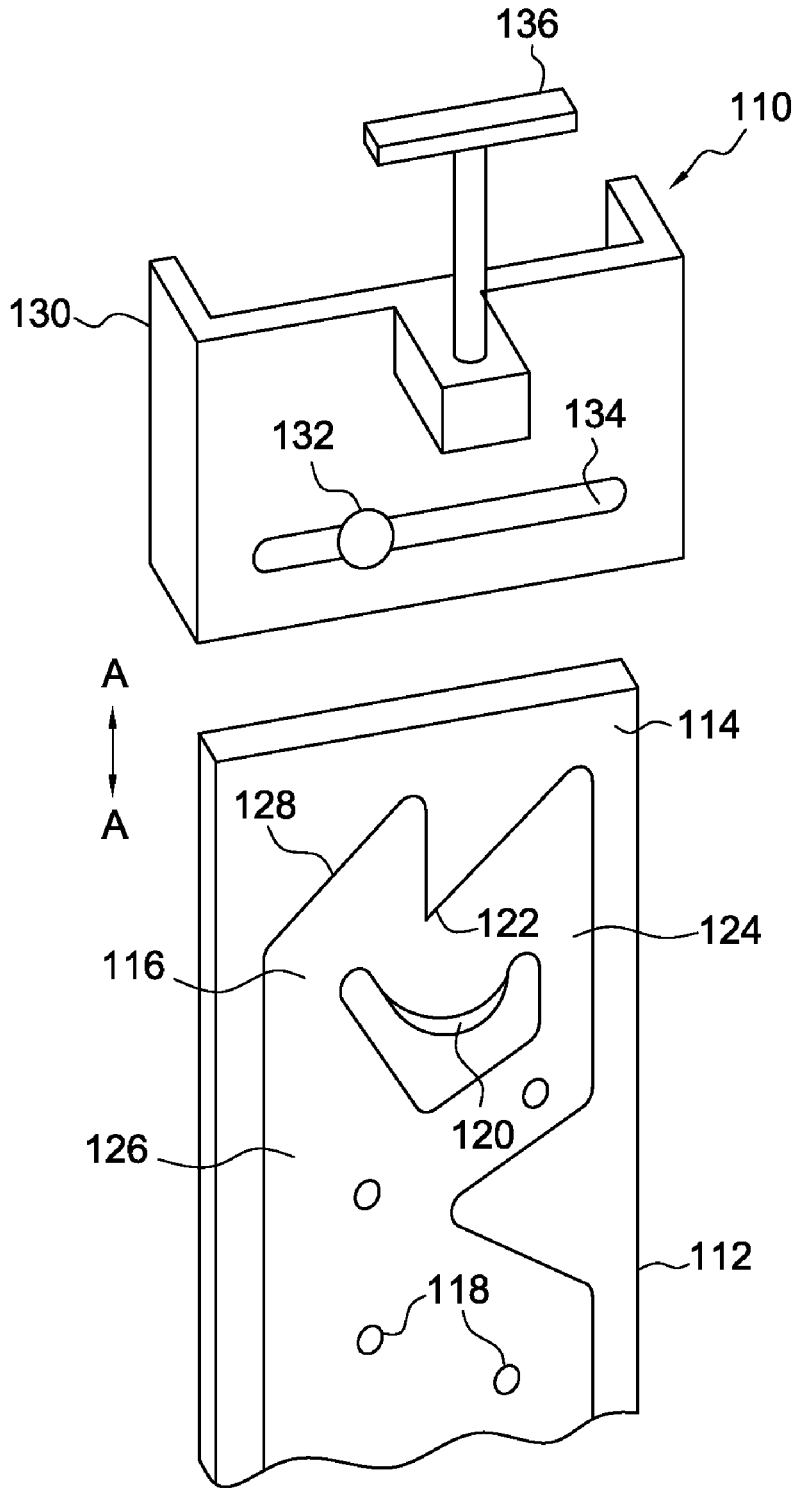
FIG. 1 (PRIOR ART)
FIG. 1 is a view of a prior art height adjustment mechanism.
Figure 2:
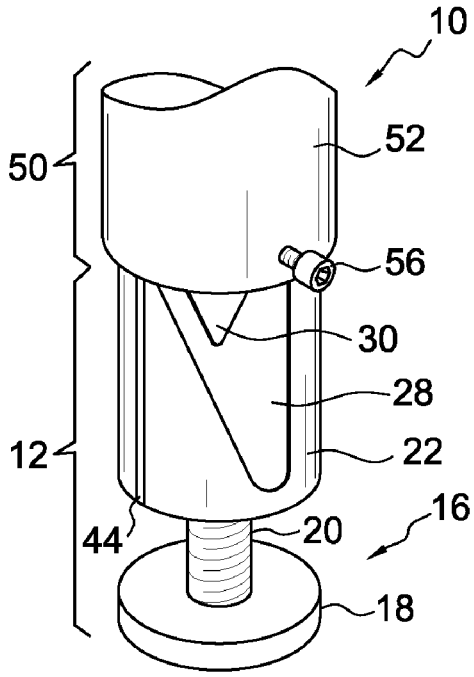
FIG. 2 is a perspective view of an embodiment of the height adjustment mechanism of the invention.

As shown in FIG. 2, the preferred embodiment of the height adjustment mechanism 10 comprises two main parts, a first portion 12, which in this embodiment has a foot 18 for engaging a floor, and a second portion 50 for connection to a snooker or pool table.

Figure 3A:
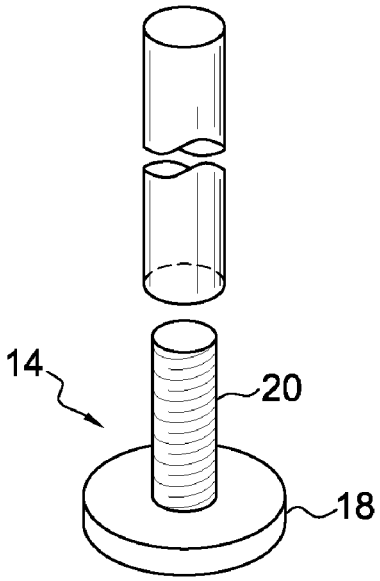
FIGS. 3*a* to 3*c* are perspective views of parts of the mechanism shown in FIG. 2.
Figure 3B:
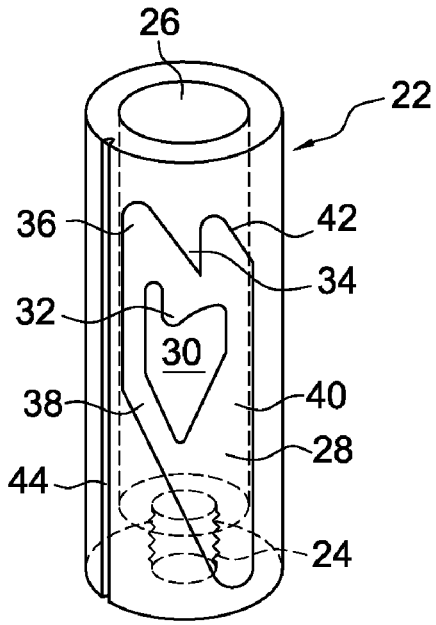

The first portion 12 comprises two parts, a floor-engaging part 14 shown in FIG. 3*a* and a grooved member shown in FIG. 3*b*.

The floor-engaging part comprises a foot 18 for resting on the floor, and a threaded rod 20 extending upwardly from the center of the foot.

The grooved member is in the form of a cylinder 22, with a threaded bore formed 24 in its lower face. The threaded rod 20 engages in the threaded bore 24, and the rod can be screwed into and out of the bore for fine adjustment purposes.

In addition, the central region of the cylinder 22 has an upwardly-open hollow 26 therein to accommodate a spring, which will be described in more detail later.

A groove 28 is machined into the outer cylindrical surface of the cylinder 22, surrounding an "island" 30. The groove 28 will be described in more detail later with reference to the operation of the height adjusting mechanism. While it is possible to use a single groove, it is preferred that a plurality of identical grooves are formed, equi-spaced around the cylinder, and it is particularly preferred to use three grooves.

Figure 3C:
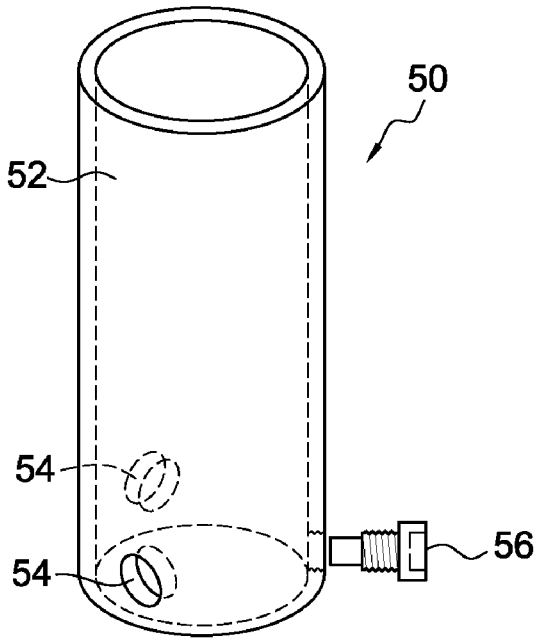

The second portion 50, show in FIG. 3*c*, is in the form of a hollow cylinder 52, whose inner diameter is slightly greater than the outer diameter of the cylinder 22 of the first portion. The hollow cylinder 52 is adapted for connection to a snooker or pool table, and may for example fit into a recess formed on the underside of the support frame of the table. It may also be positioned in the top or bottom of a leg of the table. The embodiment described is intended to fit into the bottom of a leg.

In the assembled state of the height adjustment mechanism, the cylinder 22 fits inside the hollow cylinder 52, as shown in FIG. 2. This fit must be tight, to prevent lateral movement of the bed of the table. Additional grooves 44 can be formed on the outside of the cylinder 22 along its length, to allow passage of air into and out of the central part of the hollow cylinder. If these grooves are not provided, and the fit between the cylinders is sufficiently close, then the mechanism may "lock" as a result of pressure difference between the outside and the inside of the mechanism.

At least one bore 54 is formed through the hollow cylinder, towards its lower end, and a peg 56 is fitted into the bore. The length of the peg 56 is such that it projects into the hollow central region of the hollow cylinder 52, the projecting length being slightly less than the depth of the groove 28 machined into the cylinder 22 of the first portion, so that the peg 56 can engage in the groove 28. The number of bores and pegs is the same as the number of grooves.

A spring is positioned between the hollow cylinder 52 of the second portion and the cylinder 22 of the first portion. This spring serves to bias the portions apart, and therefore tends to push the cylinder 22 out of the hollow cylinder 54.

The operation of the height adjusting mechanism will now be described.

When the bed is in its lifted (playing) position, the peg 56 engages in a detent 32 formed at the upper end of the "island" 30. The peg 56 is retained therein by the weight of the bed urging it downwardly, and also by the spring urging the cylinder 22 out of the hollow cylinder 52.

When it is desired to move the bed to its lowered (dining) position, the bed is lifted, and the peg 56 is lifted from the detent 32. The peg 56 comes into contact with a rib 34, and exerts a sideways force on it. As a result of this force, the cylinder 22 is forced to rotate in the hollow cylinder 52. Further, the presence of the spring also serves to urge the cylinder and the hollow cylinder apart, which prevents the peg 56 from jamming in the groove. In addition, the preferred embodiment uses three pegs moving in three grooves, and it is extremely unlikely that all three pegs will jam simultaneously; if one peg jams, the force exerted on the other pegs will tend to unjam it.

The peg 56 moves to region 36 of the groove (although it will be appreciated that this movement of the peg is partly achieved by the groove moving relative to the peg as the cylinder 22 rotates).

The bed is then lowered, and the peg 56 moves downwardly in groove 38 to the side of the detent 32. This movement of the peg 56 past the detent 32 allows the bed of the table to be lowered. During this motion, the spring is compressed.

When it is desired to move the bed back to its lifted (playing) position, the bed is again lifted. The peg now moves along groove 40, and at the top of the groove the peg 56 is moved sideways relative to the groove by rib 42. Again, it will be appreciated that this sideways movement is achieved by the cylinder 22 rotating in the hollow cylinder 52. Further, it will also be appreciated that the presence of the spring urging the cylinder and the hollow cylinder away from each other, and the presence of a plurality of pegs and grooves, helps to prevent the peg from jamming. The bed is then lowered, so that the peg 56 enters detent 32.

Fine adjustment of the height, to ensure that the surface of the table is level, can be achieved by rotating the foot 18 relative to the cylinder 22, thus screwing the threaded rod 20 in and out of the threaded bore 24.

It will be appreciated from the above that at least the preferred embodiment of the height adjustment mechanism is much less prone to jamming than the prior art mechanism. Further, the preferred embodiment of the height adjustment mechanism does not need to be positioned directly between the frame and the bed, thus allowing a greater freedom for the designer. Indeed, the mechanism can be fitted directly between the legs and the bed, thus avoiding the requirement for a frame. Of course, if the mechanism is not fitted into the bottom of the legs of the table, then there is no need for the mechanism to include a fine adjustment mechanism, as described. Instead, a separate fine adjustment mechanism can be installed in the bottom of the leg, to allow the table to be leveled.

It will also be appreciated that a number of variations can be made to the height adjusting mechanism. For example, the arrangement of the pegs and grooves could be reversed, so that the pegs are carried on the cylinder and the grooves are formed on the hollow cylinder. Further, although the height adjustment mechanism has been described in the context of snooker, pool and billiard tables, it can of course be used in other situations.

Figure 4:
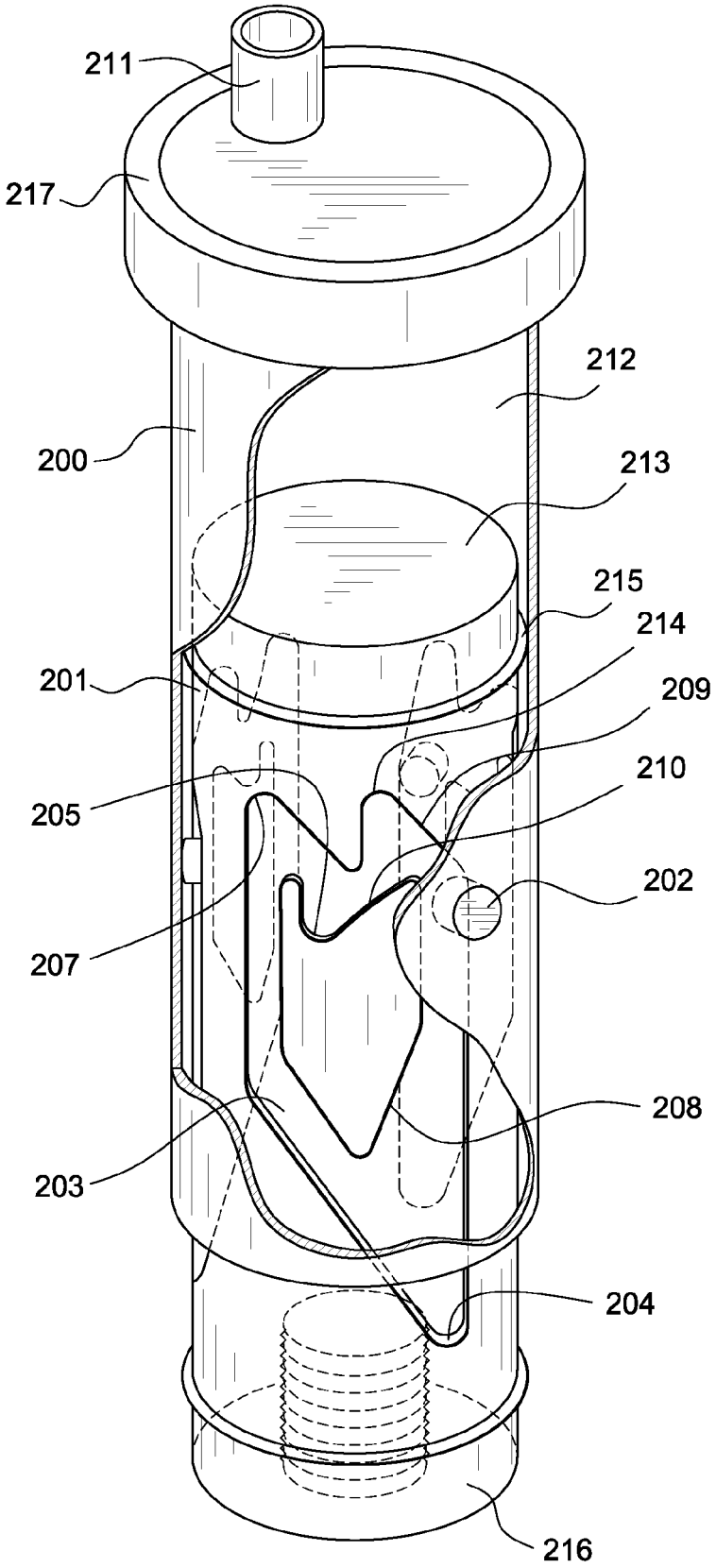
FIG. 4 shows a cut away perspective view of a height adjustment mechanism of the present invention.

As shown in FIG. 4, the position adjustment mechanism comprises a first element in the form of an outer cylindrical portion 200 and a second element in the form of an inner cylindrical portion 201 which is slidably received in the outer cylindrical portion.

The outer cylindrical portion 200 is provided with one or more cam followers in the form of pegs 202 which are received within a cam circuit 203 provided on an outer face of the inner cylindrical portion 201. The cam circuit may be cut into the outer surface of the inner cylindrical portion 201.

As is described above, relative longitudinal movement of the inner and outer cylindrical portions causes each peg to move around its cam circuit. In this respect, each cam circuit includes a lower bay or detent 204 and an upper bay or detent 205 in which the pegs can seat.

The cam circuit is configured for directing each pegs between these bays.

In use, the outer cylindrical portion 200 is attached to an object requiring raising and lowering via bolts or the like in flange 217. The inner cylindrical portion is attached to a foot 216 for engaging the ground or other support surface. Other forms of attachment means may be provided for supporting the inner cylindrical portion. Hence the pegs 202 are naturally urged downwardly together with the outer cylindrical portion so that they will seat in one of bays 204 or 205. The mechanism of attachment to the object need not be provided at the top of the outer cylindrical portion but can be provided at any suitable position on the outer cylindrical portion 200.

With the peg positioned in the lower bay 204, moving the inner and outer cylindrical portions substantially longitudinally away from one another will result in the peg moving upwardly in the cam circuit. Slight deviations in vertical movement will be accommodated by the inclined surface 208, so that the peg will ultimately engage surface 209 and be directed into detent 214, above inclined surface 210 of bay 205. Hence on a further substantially longitudinal relative movement, this time in a direction moving the inner and outer cylindrical portions together, the peg will fall into bay 205. Movement of the peg from bay 205, back to bay 204 is conducted in a similar fashion.

Hence, in the embodiment shown in FIG. 4, in order to raise and then lower the object through one complete cycle of the cam circuit, the inner and outer cylindrical portions are moved in alternating longitudinal directions, i.e. apart then together, then apart and then together.

In this connection, a fluid inlet/outlet 211 allows fluid to be introduced into and released from a chamber 212 formed between a top end face 213 of the inner cylindrical portions 201 and an upper internal portion of the outer cylindrical portions 200. Multiple inlet/outlets may be provided.

With the arrangement shown, the inner cylindrical portion effectively becomes a piston within the outer cylindrical portion. When it is desired to raise the object in question, fluid is introduced under pressure into the chamber 212, so that the inner cylindrical portion is forced downwardly within the outer cylindrical portion. Hence the peg moves with the outer cylindrical portion from bay 204, into engagement with surface 209 and then into bay 214. At this point, pressure is released from the chamber so that the outer cylindrical portion, under the weight of the object being supported, is urged downwardly. The peg thus moves via engagement surface 209 and bay 214 into bay 205. This represents a high position of the object being supported.

The process is repeated to move the peg from bay 205 back to bay 204 and complete one circuit of the cam circuit. In other words, the chamber is again pressurized until the peg is at position 207, whereupon the pressure is released such that the peg drops down and is directed to bay 204.

Sensors may be positioned at suitable locations such that the position of the peg in detents 207 and 214 is detected for enabling the pressure to be released from chamber 212 at the appropriate time. Also suitable seals, such as an O-ring seal 215 are provided to ensure effectiveness of the pressurized fluid in chamber 212. The pressure can be released slowly for a controlled lowering of the object.

In the context of a table, with such an arrangement all four legs can be raised and lowered at the same time with ease and without any requirement for physical lifting by a user.

Three non-diametrically opposed cam circuits and pegs are provided around the circumference of the inner and outer cylindrical portions. Three equi-spaced cam circuits and pegs are particularly preferred as this offers a highly stable support construction. In this respect, not having the pegs diametrically opposite one another is advantageous in that otherwise an axle is effectively formed on which the inner cylindrical portion will tend to rock.

The fluid for use in the system may be a liquid or gas or a combination of the two. In this regard, while gases tend to present greater sealing problems, should there be a leakage then less damage is likely to occur, compared with a liquid leak.

The mechanism for moving the inner and outer cylindrical portions apart is hence provided in the form of a hydraulic or pneumatic arrangement. Separate inlets and outlets for the fluid may be provided where this is more suitable.

Figure 5:
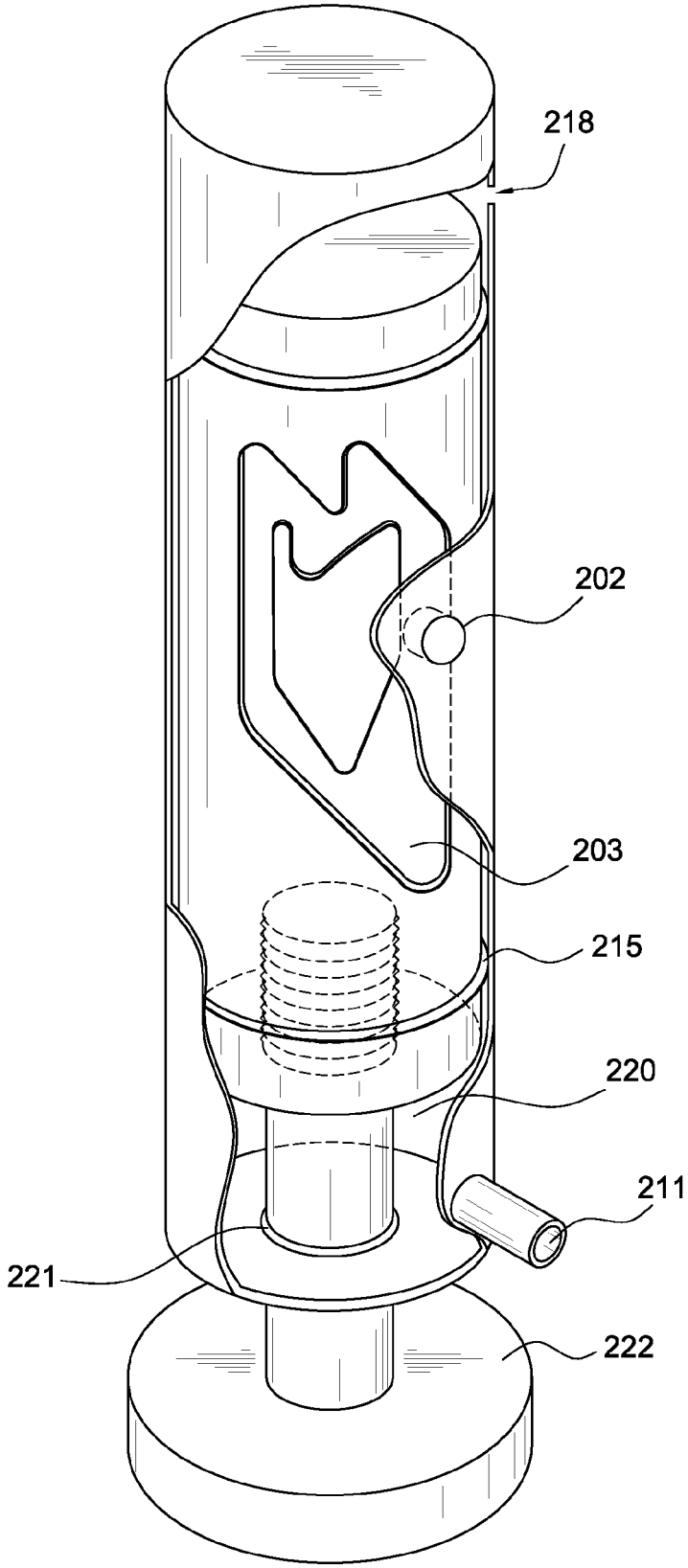
FIG. 5 shows a cut away perspective view of a height adjustment mechanism of a second embodiment of the present invention.

In an alternative arrangement, the mechanism for moving the outer cylindrical portion and peg upwardly with respect to the inner cylindrical portion may comprise a vacuum arrangement, as shown in FIG. 5, a chamber 220 in this regard being formed by extending the outer cylindrical portion below a base of the inner cylindrical portion, with suitable seals 221 provided around an extended foot section 222. Alternative forms of mounting devices may be provided for attachment to the inner cylindrical portion. A vent 218 is provided in the upper part of the outer cylindrical portion.

The mechanism is not limited to use with tables and may for example be incorporated into other systems which require raising and lowering of a substantial load. Further examples include raising/lowering of scaffolding, or levelling a boat in dry dock. The cam circuit could in this respect have detents or bays at various heights to allow for more variable height adjustment, such that an object could be raised or lowered between more than two positions.

Figure 6:
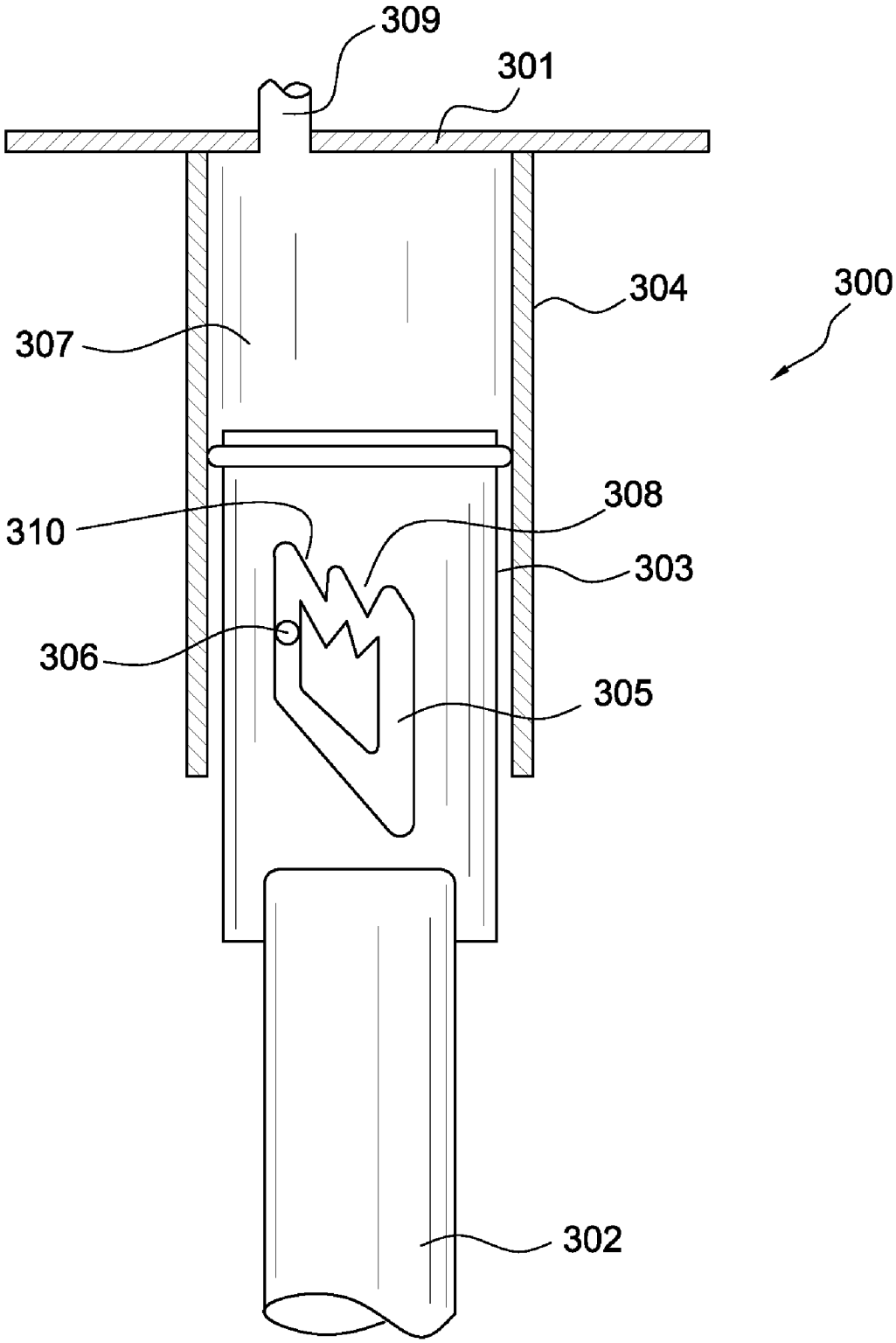
FIG. 6 shows a partial cross-sectional view of a height adjustment mechanism of a third embodiment of the present invention.

The present invention can hence be incorporated, as shown in FIG. 6, into for example, a height adjustment system for adjusting the height of a support for a boat in dry dock.

As shown, an upper part of a height adjustment assembly 300 for a boat support is attached at one end to a boat support frame 301 and at another end houses a foot post 302. The assembly includes inner and outer cylindrical portions 303, 304 as before with associated cam circuits 305 and pegs 306.

In order to raise the height of the support frame, the pressure of fluid in chamber 307 is increased by introducing fluid through inlet/outlet 309 and then released to direct the peg in a first bay 308 in the cam circuit. To further raise the boat support, the pressure in the chamber is again increased and then released such that the peg is raised to the second bay 310. To reduce the height of the support frame the pressure in the chamber is again increased and then released.

In this regard, it has been calculated that in order to raise the height by around 100 mm, 4 such assemblies (one on each corner of a boat support frame), each having a diameter of around 65 mm would raise a boat and support frame of 3000 Kg in 7.5 seconds, using 0.49 kW or 0.66 Hp rated pump.

Figure 7:
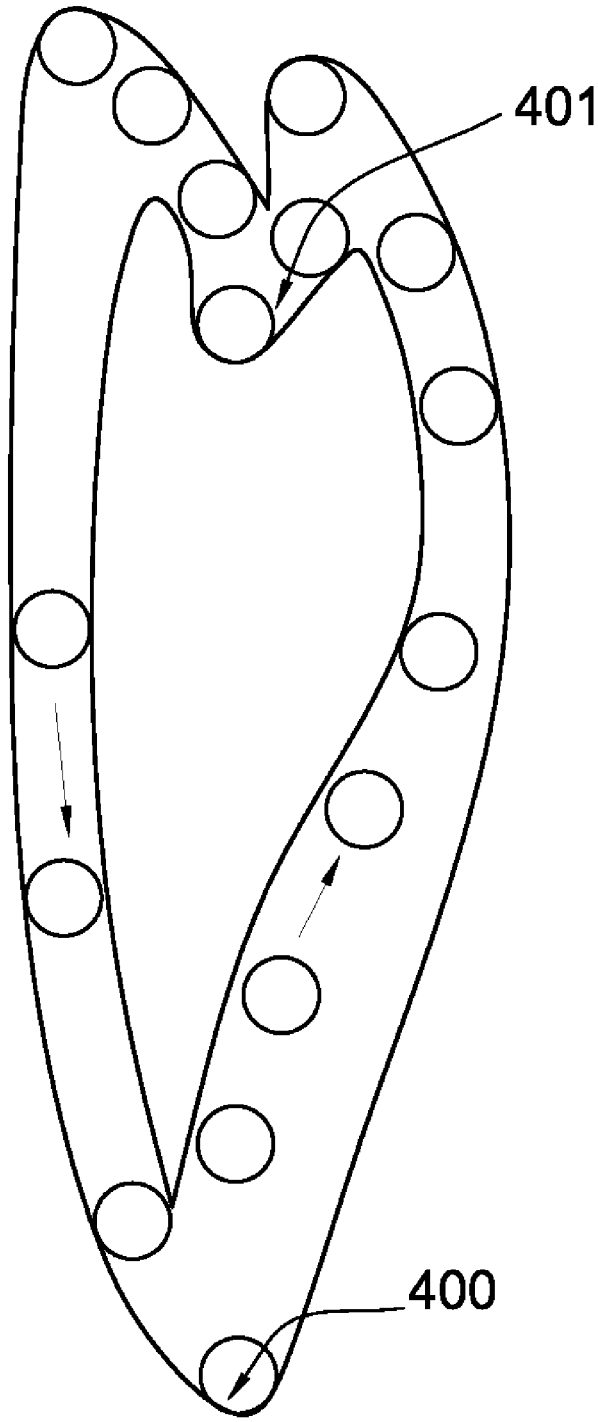
FIG. 7 shows a further embodiment of a cam circuit.

As shown in FIG. 7, the detents or bays in the cam circuit may be aligned in the longitudinal axis of the cylindrical portions. In other words, a lower detent 400 is vertically below an upper detent 401. This means that the process of moving the cam follower from one bay to another does not leave the cylindrical portions relatively twisted. The cam follower is shown in many positions in FIG. 7 to illustrate how it moves around the cam circuit.

What is claimed is:

1. A position adjustment mechanism, comprising two cylindrical portions, a first one of the cylindrical portions being slidably disposed inside a second one of the cylindrical portions, said second cylindrical portion defining a chamber having a closed upper end containing a fluid inlet/outlet opening, said first cylindrical portion arranged in sealing relation within said chamber, and further comprising means for moving said cylindrical portions relative to each other by introducing and removing pressurized fluid to said chamber via said inlet/outlet opening in said second cylindrical portion, wherein one of the cylindrical portions has at least three detents and the other cylindrical portion has at least three members for engaging in respective ones of said detents to hold said cylindrical portions in a first position, the members being removable from said detents to allow said cylindrical portions to move into a second position, wherein the detents and members are equally spaced around the first and second cylindrical portions.

2. A mechanism as claimed in claim 1, wherein said cylindrical portions have axes arranged generally vertical, and said detents are upwardly open.

3. A mechanism as claimed in claim 1, wherein said detents are formed on said first cylindrical portion.

4. A mechanism as claimed in claim 3, wherein said members are formed on said second cylindrical portion.

5. A mechanism as claimed in claim 4, wherein said detents each form part of a groove formed on said first cylindrical portion, said members engaging in respective said grooves.

6. A position adjustment mechanism, comprising two cylindrical portions, a first one of the cylindrical portions being slidably disposed inside a second one of the cylindrical portions, said second cylindrical portion defining a chamber having a closed upper end containing a fluid inlet/outlet opening, said first cylindrical portion arranged in sealing relation within said chamber, and further comprising means for moving said cylindrical portions relative to each other by introducing and removing pressurized fluid to said chamber via said inlet/outlet opening in said second cylindrical portion, wherein said first cylindrical portion has at least three detents each of which forms part of a groove on said first cylindrical portion and said second cylindrical portion has at least three members for engaging in respective grooves of said detents to hold said cylindrical portions in a first position, the members being removable from said detents to allow said cylindrical portions to move into a second position, wherein the detents and members are equally spaced around the first and second cylindrical portions and wherein said grooves form respective circuits, said members moving around their respective circuits as the cylindrical portions move from their first position to their second position and back to their first position.

7. A mechanism as claimed in claim 5, having an odd number of grooves and a corresponding odd number of members, greater than 1.

8. A mechanism as claimed in claim 1, where one of said cylindrical portions is in contact with a first body and the other of said cylindrical portions is in contact with a second body, motion of the cylindrical portions between the first position and the second position serving to adjust the distance between the bodies.

9. Apparatus for holding two cylindrical elements at two longitudinally spaced positions relative to each other, the apparatus comprising:

a) a cam circuit provided on a first one of said cylindrical elements;

b) a cam follower provided on a second one of the cylindrical elements, said second cylindrical element defining a chamber having a closed upper end containing a fluid inlet/outlet opening and said first cylindrical element being arranged in sealing relation within said chamber; and c) means for moving said cylindrical elements relative to each other by introducing and removing pressurized fluid to said chamber via said inlet/outlet opening in said second cylindrical element, wherein the cam circuit directs the cam follower around the circuit as a result of alternating relative longitudinal movement of the first and second cylindrical elements.

10. Apparatus according to claim 9, and further comprising a plurality of cam circuit/cam follower combinations positioned non-diametrically around a circumference of the cylindrical portions.

11. Apparatus according to claim 10, wherein three such cam circuit/cam follower combinations are provided at equal intervals around a circumference of the cylindrical portions.

* * * * *